US006474628B1

(12) United States Patent
Stroh et al.

(10) Patent No.: US 6,474,628 B1
(45) Date of Patent: Nov. 5, 2002

(54) AIR HUMIDIFICATION

(75) Inventors: Norbert Stroh, Magstadt; Eckehard Walitza, Aalen, both of (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 0 days.

(21) Appl. No.: 09/700,264

(22) PCT Filed: Feb. 11, 2000

(86) PCT No.: PCT/EP00/01124

§ 371 (c)(1),
(2), (4) Date: Dec. 7, 2000

(87) PCT Pub. No.: WO00/53977

PCT Pub. Date: Sep. 14, 2000

(30) Foreign Application Priority Data

Mar. 1, 1909 (DE) ..... 199 10 441

(51) Int. Cl.[7] ..... B01F 3/04
(52) U.S. Cl. ..... 261/99; 261/107
(58) Field of Search ..... 261/99, 104, 107, 261/154

(56) References Cited

U.S. PATENT DOCUMENTS

| | | | | | |
|---|---|---|---|---|---|
| 2,254,500 | A | * | 9/1941 | Seibold | 261/99 |
| 2,990,696 | A | * | 7/1961 | Fisher | 261/104 |
| 3,523,681 | A | * | 8/1970 | Jaye | |
| 3,735,559 | A | * | 5/1973 | Salemme | 261/104 |
| 3,834,360 | A | * | 9/1974 | Blitch | 261/99 |
| 3,912,795 | A | * | 10/1975 | Jackson | 261/104 |
| 4,063,899 | A | * | 12/1977 | Cheron et al. | 261/99 |
| 4,098,852 | A | * | 7/1978 | Christen et al. | 261/104 |
| 4,146,597 | A | * | 3/1979 | Eckstein et al. | 261/107 |
| 4,976,113 | A | * | 12/1990 | Gershuni et al. | 261/104 |
| 5,273,689 | A | | 12/1993 | Hamasaki | |
| 5,348,691 | A | * | 9/1994 | McElroy et al. | 261/104 |
| 5,996,976 | A | * | 12/1999 | Murphy et al. | 261/107 |
| 6,145,818 | A | * | 11/2000 | Herbst | 261/154 |

FOREIGN PATENT DOCUMENTS

| | | | | |
|---|---|---|---|---|
| EP | 0370540 | | 5/1990 | |
| EP | 0661503 | | 7/1995 | |
| EP | 0707179 | | 4/1996 | |
| JP | 61-72948 | * | 4/1986 | 261/104 |
| JP | 61-072949 | | 4/1986 | |
| JP | 2-192527 | | 7/1990 | |
| JP | 5-010559 | | 1/1993 | |
| JP | 8-145420 | | 6/1996 | |
| JP | 09257282 | | 9/1997 | |

* cited by examiner

*Primary Examiner*—C. Scott Bushey
(74) *Attorney, Agent, or Firm*—Ostrolenk, Faber, Gerb & Soffen, LLP

(57) ABSTRACT

The present invention relates to an air humidifier and to a method for humidifying air, the use of special devices enabling air to be humidified with sterile water. A large contact area between water and air is combined with low losses of flow pressure. A membrane contactor having at least one tube membrane embedded in a hydrophilic, porous body comprises the air humidifier. The present invention enables use of coarse filters to ensure that the water is dispersed over a large surface area.

23 Claims, 4 Drawing Sheets

AIR HUMIDIFICATION

BACKGROUND OF THE INVENTION

The present invention relates to a device for humidifying air and to a method for air humidification using this device.

The use of air with a defined humidity is desirable or required in many cases, for example in air-conditioning technology or in medicine. Air from compressed-air lines or cylinders is generally too dry, while atmospheric air exhibits considerable fluctuations in terms of its humidity and, moreover, its composition often fails to satisfy requirements.

Various methods are used to humidify air. In most cases, water is sprayed or vaporized. For example, a conventional method uses, for example, an open water reservoir, from which liquid is pumped out and sprayed into the flow of air. The water which is not taken up by the flow of air flows back into the reservoir. The microorganisms introduced multiply in this water reservoir and can only be controlled by the use of chemicals. Therefore, in many situations the humidified air is undesirably polluted with chemicals. To counteract the microorganisms, methods have been developed according to which the humidification water was heated. However, it has emerged that even dead microorganisms or their cell constituents may impair the respiratory tract of humans. Therefore, alternative methods have been developed which envisage water vapor being introduced into the air to be humidified. In these methods, the water is heated to boiling point and only the vapor phase is used for the humidification. A drawback of these methods is the long mixing paths required in order to achieve uniform humidification. Finally, it is known for water to be sprayed directly into the room which is to be air-conditioned. This, however, requires an optimum distribution of a very large number of nozzles in order to achieve uniform humidity throughout the room. Moreover, this system cannot be integrated into an existing air-conditioning unit without further measures.

It is known, for example from EP 0 370 540 A1 and U.S. Pat. No. 5,348,691, to sterilize water by filtration using membranes. According to the methods described in those documents, dry air from a blower is passed through a membrane contactor, the membrane contactor separating the liquid phase, i.e. water, from the air and exposing the airflow to a large area of water in a very small space. The water molecules evaporate from the water surface and pass into the airflow. The membranes employed are hydrophilic and hydrophobic membranes, preferably in capillary form. For the generally large airstreams, it is necessary to provide a large membrane area combined with a low loss of flow pressure. With both flat and hollow fiber membranes, this leads to very short modules with very large end faces, i.e. inlet surfaces. To achieve the required low pressure losses, the flow channels have to be relatively large or the hollow fiber diameters must not be too small. However, this entails the drawback that it is impossible to achieve a high packing density. In addition, large-scale production of modules of this nature has not yet been tried and will certainly entail a very complex method.

SUMMARY OF THE INVENTION

The present invention is therefore based on the technnical problem of providing an air humidifier which overcomes the abovementioned drawbacks, in particular provides a large contact area between water and air combined, at the same time, with low losses of flow pressure.

The present invention solves this technical problem by providing an air humidifier, comprising a membrane contactor, in which the membrane contactor has at least one tube membrane embedded in a hydrophilic, porous body. In a particularly preferred embodiment of the invention, the hydrophilic, porous body is a body made from a ceramic material, referred to below as a ceramic body. The body may consist exclusively of the ceramic material or may contain substantial amounts, preferably more than 50% by weight, based on the weight of the body, of this material. According to the invention, it is possible, for example, to use coarse ceramic filters such as are used for filtering molten metals. In another preferred embodiment of the invention, the hydrophilic, porous body is made from a polymer, i.e. consists of this polymer or contains substantial amounts, preferably an amount of more than 50% by weight, based on the weight of the body, of this polymer. Naturally, it is also possible to use hydrophilic, porous bodies made from other materials, provided that these materials are able to ensure that the water is dispersed over a large surface area. According to the invention, organic or inorganic woven fabrics or woven-fabric-like structures consisting of or containing substantial proportions, preferably more than 50% by weight (based on the weight of the body), of porous filament material, may also be used as the only or principal constituent of the body. The body should be hydrophilic and have a porous structure, i.e. a structure of increased surface area. In addition, it is necessary for the hydrophilic, porous body to be sufficiently strong and rigid for the incoming flow of air not to cause any compression and therefore any significant change in the pore structure and flow velocities. Therefore, bodies which are used according to the invention preferably have a self-supporting, non-compressible structure.

In a preferred embodiment of the present invention, the diameter of the pores in the hydrophilic, porous body is less than or equal to 5 mm.

In connection with the present invention, a membrane contactor is understood as meaning the unit according to the invention comprising at least one tube membrane and hydrophilic, porous body. The function of a membrane contactor is to sterilize the water by means of the at least one tube membrane contained therein, while the hydrophilic, porous body serves as an area-enlarging contact means between air and sterile water. The membrane contactor according to the invention may be fitted, in conventional air humidifiers, in the form of a module individually or in series or parallel with other modules and the water supply. The use of the membrane contactor according to the present invention in an air humidifier is possible wherever humidified, sterile air is required, for example in air-conditioning units, be they stationary, for example in building, or in mobile units, such as vehicles, in room air humidifiers, sterile working areas, operating theaters, laboratories, for the production of medicaments or sterile appliances or for storing valuable cultural materials, such as books, or in storage and exhibition areas, museums, etc.

In the context of the present invention, a membrane is understood as meaning a technical membrane, particularly preferably a thin, film-like, microporous separating layer. A porous membrane of this nature may have a foam-like mesh structure. According to the invention, it is equally possible to use homogenous membranes and membranes of asymmetric structure, for example comprising a supporting layer and a separating layer.

The membrane according to the invention is therefore preferably a membrane filter which particularly preferably may be produced, for example, from ceramic or polymeric material, for example cellulose derivatives, polyamides, polyvinyl chloride, polysulfone and/or teflon and consists of this material or contains substantial proportions of this material, in particular more than 50% by weight. The membranes are preferably 50 to 250 μm thick.

The membranes according to the invention are designed as tube membranes.

According to the invention, it is also possible to combine capillary membranes or hollow fiber membranes to form bundles of flexible tubular bodies and to integrate these bundles in the hydrophilic body.

In a particularly preferred embodiment, the invention provides for the at least one tube membrane to be a ceramic tube membrane or a polymeric filtration membrane, in particular a microfiltration membrane. Naturally, it is also possible to use other tube membranes, provided that they are of substantially tubular form and have a pore diameter which allows microorganisms, for example bacteria, viruses, cells of human, animal or plant origin, parts thereof and/or high-molecular substances to be blocked. It is particularly preferable for the tube membranes to have pores with a diameter of <0.2 μm, in particular from 0.01 to 0.20 μm. It is also possible to use hollow filtration fibers, in particular hollow microfiltration fibers.

In a preferred embodiment of the present invention, the internal diameter of the tube membrane lies in a range from 200 μm to 16 mm.

The invention therefore provides for the water, which may contain microbes, to be passed through at least-one tube membrane, that is to say a membrane which is of tubular or hose-like form, into a hydrophilic, porous body. In the hydrophilic, porous body the water passes through the pores of the membrane into the body. According to the invention, it is now envisaged that the pores of the membrane will be sufficiently small for it to be impossible for either microorganisms or fragments of lysed microorganisms or larger molecules, which may have a toxic or allergenic action, to pass through the membrane. The tube membrane therefore acts, as it were, as a filter for undesirable constituents of the water. The water leaving the tube membrane is therefore sterile. This water passes into the pores of the porous body, where it is dispersed by capillary forces over the entire inner and upper area of the body. The air which is to be humidified is passed through the porous body, where it can take up sterile water over a relative large surface area.

The actual membrane area, that is to say the area of the tube membrane, may advantageously be relatively small, since the exchange area is for the most part provided by the inner and outer surfaces of the hydrophilic porous body and the filtration capacity of the tube membranes used according to the invention is very high, reaching levels of more than 1000 $l/M^2$ h bar.

In a particularly preferred embodiment, the invention provides for the tube membrane to pass in meandering or worm-like form through the porous body. Naturally, it is also possible for a plurality of tube membranes to pass through the body, for example in parallel, although they may also pass through the body in any other desired way. It is preferable for the at least one tube membrane to pass through the hydrophilic, porous body in such a way that a uniform supply of water to the entire region of the hydrophilic, porous body which is reached by the flow of air is ensured, in which case the distribution of the tube membranes has to be adapted to the size and porosity of the hydrophilic body and to the flow of air.

In another preferred embodiment, the invention provides for the hydrophilic, porous body to be cuboidal and, accordingly, to have four side faces and two inlet and outlet faces which lie opposite one another. In a further preferred embodiment of the invention, both the inlet surface area and the outlet surface area of the cuboid are larger than each of its individual side faces, preferably by a factor of from 2 to 50, particularly preferably 10 to 30.

It is also possible for the areas of the inlet and outlet surfaces to differ, for example for the outlet surface area to be larger than the inlet surface area, in order in this way to enhance the fluid dynamics.

In another preferred embodiment of the invention, the ratio of the inlet surface area of the hydrophilic, porous body to the area of the tube membrane incorporated in the hydrophilic, porous body is from 10 to 25, preferably 15 to 25, in particular 20.

In a further preferred embodiment, the invention envisages the longitudinal axis, preferably the longitudinal axes, of the at least one tube membrane, preferably of the plurality of tube membranes, to lie in at least one plane which is parallel to the inlet surface of the hydrophilic, porous body. In this case, it is possible for the tube membrane to lie in one or more planes parallel to the inlet surface of the hydrophilic, porous body.

The invention also provides an air humidifier which contains a housing and air-supply and air-discharge devices, a membrane contactor according to the invention and, if appropriate, devices for moving the air, such as pumps or fans. The invention also envisages that the membrane contactors of the present invention can be fitted together to form a modular system comprising a plurality of membrane contactors, in which case it is entirely possible for a plurality of hydrophilic, porous bodies to use one or more common tube membranes, i.e. this/these tube membrane(s) run(s) through a plurality of bodies. Naturally, the invention also relates to air-conditioning systems which contain membrane contactors or air humidifiers in accordance with the invention.

The invention also relates to a method for the sterile humidification of air, in which water is passed into the at least one tube membrane of an air humidifier of the present invention, from where it passes through the pores of the tube membrane into the hydrophilic, porous body of the air humidifier or membrane contactor, where it is dispersed and taken up by a flow of air which is being passed through the hydrophilic, porous body.

In a further preferred embodiment, the invention provides a method of the abovementioned type in which the flow of air is introduced into the hydrophilic, porous body of the membrane contactor perpendicular to the longitudinal axis of the tube membrane.

In this case, the invention has the advantage that there are short diffusion paths for the water perpendicular to the direction of the flow of air and that the short paths, the form of which differs considerably in flow cross section, of the pores through which the medium flows, which pores also have cross-connections with other pores, means that laminar flows are not formed. According to the invention, this has the advantage that there is no need for a mixing zone downstream of the humidification zone.

BRIEF DESCRIPTION OF THE DRAWINGS

The invention is explained in more detail with reference to the following example and the associated Figure.

DESCRIPTION OF A PREFERRED EMBODIMENT

Figure 1A:
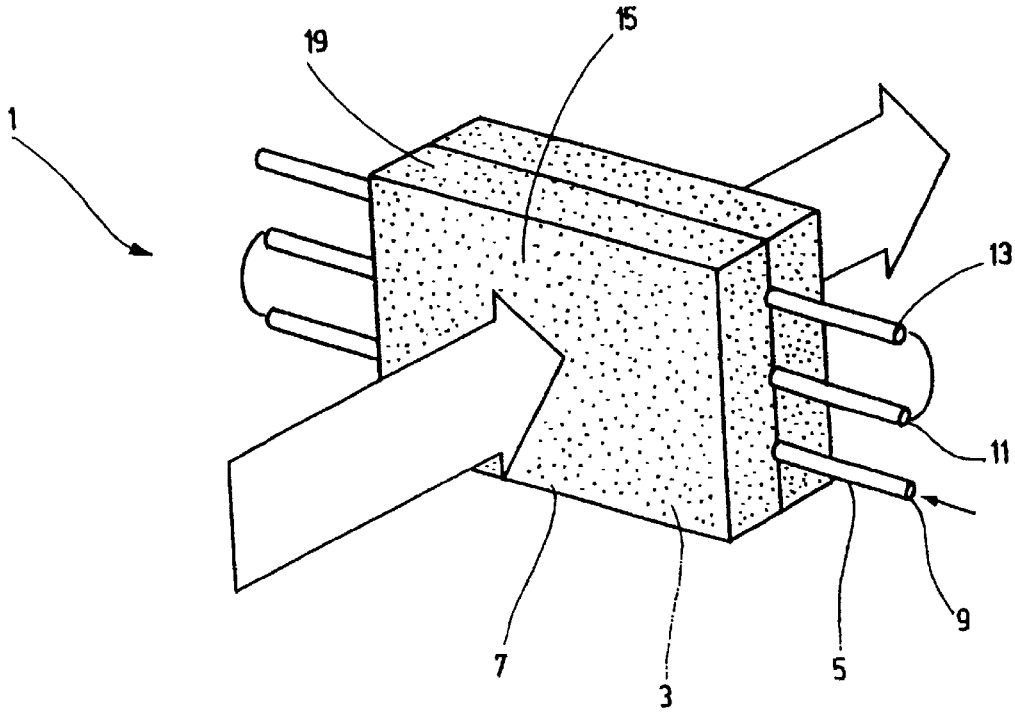
FIG. 1A shows a membrane contractor in accordance with the principles of the present invention.
Figure 1B:
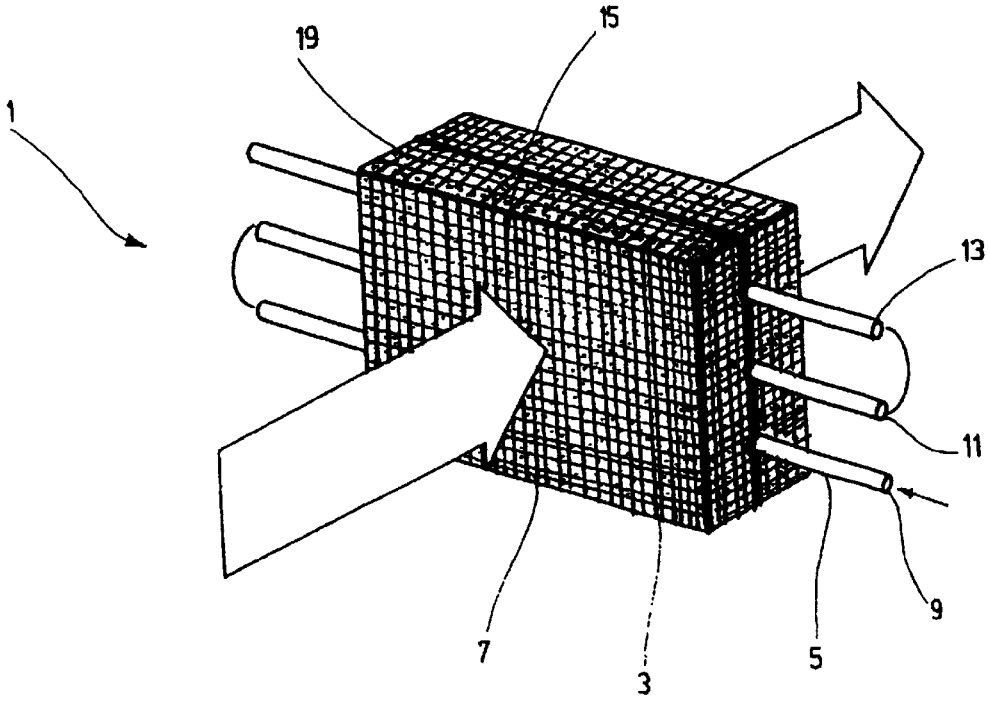
FIG. 1B shows a woven fabric-like structure, as described above, in accordance with the principles of the present invention.
Figure 1C:
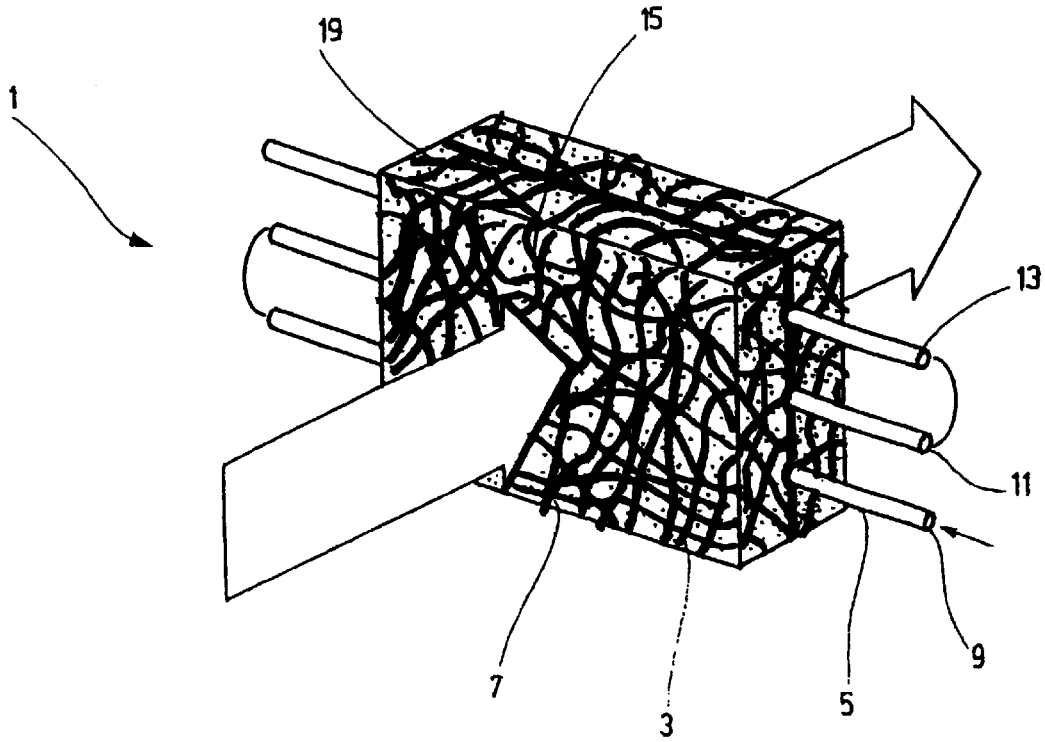
FIG. 1C depicts a tube membrane passing in a meandering or worm-like form through the core's body, as described above, in accordance with the principles of the present invention.
Figure 1D:
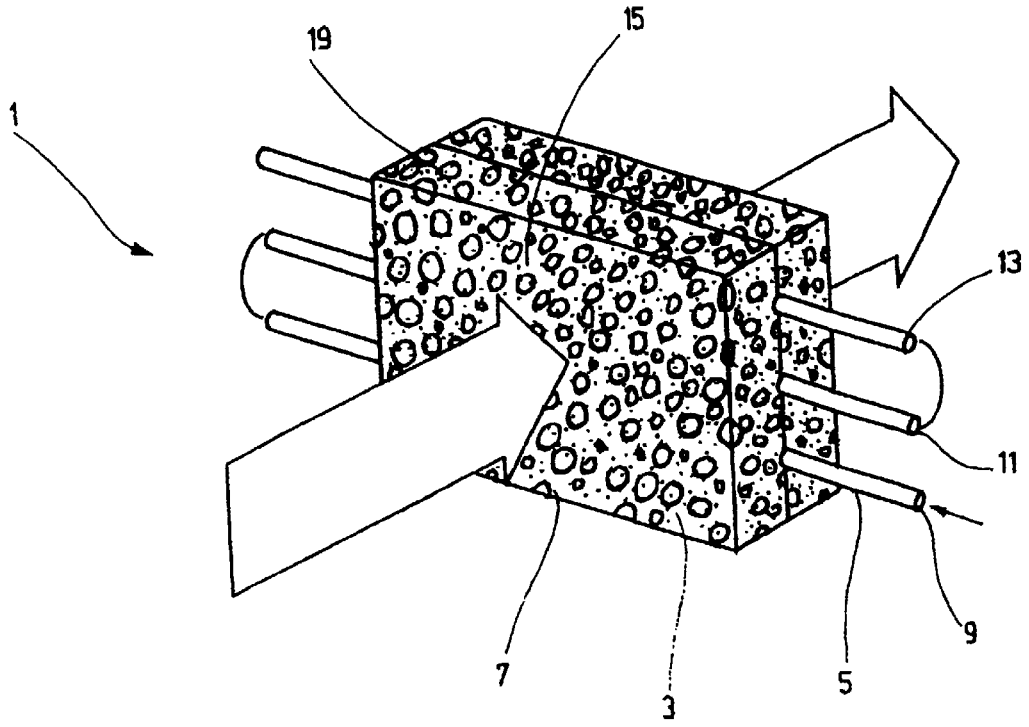
FIG. 1D shows a porous membrane having a foam-like mesh structure, as described above, in accordance with the principles of the present invention.

FIG. 1A shows a membrane contactor 1 comprising a hydrophilic, porous, cuboidal body 3 made from ceramic material and a ceramic tube membrane 5 running through it. FIG. 1A also illustrates the pores 7 in the body 3 and the direction in which the air flows onto and through the body, in the form of the large arrows. FIG. 1A shows the path of the tube membrane 5, which is designed as a tubular microfiltration membrane, the longitudinal axes of the three branches 9, 11, and 13 and the tube membrane 5 being arranged parallel to one another and centrally in the body 3 in a plane which is parallel to the inlet surface. The curved connecting pieces between the branches 9, 11 and 13 of the tube membrane 5 are not shown or only sketchily indicated. The pores in the tube membrane 5, which have a diameter of 0.1 $\mu$m, are also not shown. The hydrophilic, porous ceramic body 3 comprises two ceramic plates which are each 2.5 cm thick. In their principal surfaces which face toward one another, semicircular passages are formed, which serve to hold the tube membrane 5. The two ceramic plates are placed on top of one another, with the tube membrane 5 between them, and are connected by means of a suitable fixing means. The membrane contactor 1 formed in this way is positioned in the airflow in an air humidifier (not shown) in such a way that the air flows at right angles onto the end or inlet face 15, that is say one of the two largest faces, of the cuboid. The tube membrane 5 runs at right angles to the inlet direction of the air. Naturally, a different arrangement or number of the tube membrane 5 in the body is also possible. In order for the method according to the invention to be carried out efficiently, it is desirable for the supply of water to the hydrophilic, porous body 3 through the tube membrane 5 to be as uniform as possible.

Water is transferred under pressure into the body 3 (small arrow in the figure) through the tube membrane 5, which outside the body 3 is enclosed in a watertight manner, for example by means of a film, and then passes through the membrane pores into the body 3. In the process, undesirable microorganisms, fragments thereof and high-molecular constituents are retained in the tube membrane 5. The capillary forces cause the water to be dispersed over the entire inner and outer surface of the porous structure. The air to be humidified flows into the porous, hydrophilic body 3 at right angles to the longitudinal axis of the tube membrane 5 and takes up the sterile water. On account of the short diffusion paths for the water perpendicular to the direction of the flow of air and the short paths, the form of which differs considerably in flow cross section, of the pores through which the medium flows, laminar flows are not formed. At air velocities of 2.5 m/s, it is possible to achieve humidification capacities of 50 to 100 kg/h per $m^2$ of inlet surface area. Under standard conditions, 17 g of water per 1 $m^3$ (s.t.p.) of air are required to saturate dry air. Advantageously, the amount of sterile water pressed through the membrane 5 by the pressure applied on the water side is the amount required to achieve a defined humidity of the airflow blown through the porous body 3. This ensures that there is no excess water prepared and used.

What is claimed is:

1. An air humidifier comprising:

a membrane contactor comprising a hydrophilic porous body with an air inlet surface and an air outlet surface; and a tube membrane embedded in the body and extending through the body for carrying liquid and delivering liquid through the membrane to the body;

whereby air passing into the inlet surface and exiting the outlet surface may pick up moisture from the body.

2. The air humidifier as claimed in claim 1, wherein the body is comprised of a substantial proportion of a ceramic material.

3. The air humidifier as claimed in claim 1, wherein the body is comprised of a substantial proportion of a polymer.

4. The air humidifier as claimed in claim 1, wherein the body is comprised of a substantial proportion of a woven fabric-like structure.

5. The air humidifier as claimed in claim 4, wherein the body has a hydrophilic surface.

6. The air humidifier as claimed in claim 4, wherein the body is made from a porous filament material.

7. The air humidifier as claimed in claim 1, wherein the porous body has pores of a diameter of <5 mm.

8. The air humidifier as claimed in claim 1, wherein the tube membrane is comprised of a substantial proportion of ceramic material.

9. The air humidifier as claimed in claim 1, wherein the tube membrane is comprised of a substantial proportion of polymeric material.

10. The air humidifier as claimed in claim 1, wherein the tube membrane comprises a hollow microfiltration fiber or a tubular microfiltration membrane.

11. The air humidifier as claimed in claim 1, wherein the tube membrane has pores therethrough.

12. The air humidifier as claimed in claim 11, wherein the pores of the tube membrane have a diameter of $\leqq 0.2$ $\mu$m.

13. The air humidifier as claimed in claim 12, wherein the tube membrane has an internal diameter from 200 $\mu$m to approximately 16 mm.

14. The air humidifier as claimed in claim 1, wherein the tube membrane has an internal diameter of from 200 $\mu$m to approximately 16 mm.

15. The air humidifier as claimed in claim 1, wherein the body is cuboidal in shape, with six faces including the inlet surface and the outlet surface.

16. The air humidifier as claimed in claim 15 wherein the inlet surface has a surface area that is larger than the surface area of the faces of the body not opposite the inlet surface area.

17. The air humidifier as claimed in claim 1, wherein the tube membrane follows a meandering path through the porous body.

18. The air humidifier as claimed in claim 17, wherein the tube membrane has a longitudinal axis which is in a plane parallel to the inlet surface.

19. The air humidifier as claimed in claim 1, wherein the tube membrane has a longitudinal axis which is in a plane parallel to the inlet surface.

20. A method for sterile humidification of air using a humidifier comprising:

a membrane contactor comprising a hydrophilic porous body with an air inlet surface and an air outlet surface; and a tube membrane embedded in the body and extending through the body for carrying liquid and delivering liquid through the membrane to the body;

the method comprising passing water along the tube membrane such that the water passes through the porous membrane and into the porous body for dispersing water in the body; and flowing air through the body from the inlet surface through the outlet surface, for the air to take up water from the porous body as air exits the outlet surface.

21. The method of claim 20, wherein water is passed through pores in the tube membrane having a diameter of $\leqq 0.2\ \mu m$.

22. The method of claim 20, wherein the tube membrane has a longitudinal axis which is in a plane parallel to the inlet surface area;

the method further comprising introducing air into the body across the axis of the tube membrane.

23. The method of claim 23, wherein the air introduced perpendicular to the axis of the tube membrane.

* * * * *